US009573174B2

(12) United States Patent
Charre et al.

(10) Patent No.: US 9,573,174 B2
(45) Date of Patent: Feb. 21, 2017

(54) INSTALLATION AND METHOD FOR ROLLING A METAL STRIP

(71) Applicant: PRIMETALS TECHNOLOGIES AUSTRIA GMBH, Linz (AT)

(72) Inventors: Francis Charre, Balbigny (FR); Jean-Paul Faure, Erangy/Oise (FR); Yves Guillot, Trelins (FR); Stanislas Mauuary, Saint-Cyprien (FR)

(73) Assignee: Primetals Technologies Austria GmbH, Linz (AT)

( * ) Notice: Subject to any disclaimer, the term of this patent is extended or adjusted under 35 U.S.C. 154(b) by 0 days.

(21) Appl. No.: 14/769,873

(22) PCT Filed: Dec. 10, 2013

(86) PCT No.: PCT/EP2013/076081

§ 371 (c)(1),
(2) Date: Aug. 24, 2015

(87) PCT Pub. No.: WO2014/127864

PCT Pub. Date: Aug. 28, 2014

(65) Prior Publication Data

US 2016/0016212 A1 Jan. 21, 2016

(30) Foreign Application Priority Data

Feb. 22, 2013 (EP) ..... 13290036

(51) Int. Cl.
*B21B 1/22* (2006.01)
*B21B 45/02* (2006.01)
(Continued)

(52) U.S. Cl.
CPC ..... *B21B 1/22* (2013.01); *B21B 45/0239* (2013.01); *B21B 45/0269* (2013.01);
(Continued)

(58) Field of Classification Search
CPC ..... B21B 1/22; B21B 1/28; B21B 39/006; B21B 45/0239; B21B 45/0269; B21B 45/0278
See application file for complete search history.

(56) References Cited

U.S. PATENT DOCUMENTS 6,478,899 B1 11/2002 Legrand et al.
6,546,771 B1 4/2003 Ljungars
(Continued)

FOREIGN PATENT DOCUMENTS

CN 1410177 A 4/2003
CN 101087667 A 12/2007
(Continued)

*Primary Examiner* — Teresa M Ekiert
(74) *Attorney, Agent, or Firm* — Laurence A. Greenberg; Werner H. Stemer; Ralph E. Locher

(57) ABSTRACT

An installation for rolling a metal strip includes a rolling mill through which the strip is rolled as it passes continuously, rolling agents brought into contact with rolls of the rolling mill and with the strip, a strip drawing unit positioned at the outlet of the rolling mill, and a decontamination module with at least one degreaser positioned between the outlet of the rolling mill and the drawing unit so as to remove residual rolling agents from the strip at the outlet from the rolling mill. A strip accumulator is positioned at the outlet of at least part of the drawing unit, particularly so as to keep the speed of travel of the strip at the outlet of the accumulator below a maximum threshold. A paper-strip insertion module is positioned downstream of the outlet from the strip accumulator.

18 Claims, 2 Drawing Sheets

(51) Int. Cl.

| | |
|---|---|
| *B21B 1/28* | (2006.01) |
| *B21B 39/00* | (2006.01) |
| *B21B 41/00* | (2006.01) |
| *B21B 15/00* | (2006.01) |

(52) U.S. Cl.
CPC ..... *B21B 45/0278* (2013.01); *B21B 1/28* (2013.01); *B21B 39/006* (2013.01); *B21B 41/00* (2013.01); *B21B 2001/221* (2013.01); *B21B 2015/0057* (2013.01); *B21B 2275/06* (2013.01); *B21B 2275/08* (2013.01)

(56) References Cited

U.S. PATENT DOCUMENTS

| | | | |
|---|---|---|---|
| 2003/0056558 | A1 | 3/2003 | Nishi |
| 2008/0006387 | A1 | 1/2008 | Welker |

FOREIGN PATENT DOCUMENTS

| | | | |
|---|---|---|---|
| CN | 101376212 | A | 3/2009 |
| DE | 3825110 | A1 | 2/1990 |
| DE | 19843382 | A1 | 3/2000 |
| EP | 2067541 | A1 | 6/2009 |
| GB | 1313577 | | 4/1973 |
| JP | 2002504434 | A | 2/2002 |
| WO | 0037189 | A1 | 6/2000 |

INSTALLATION AND METHOD FOR ROLLING A METAL STRIP

BACKGROUND OF THE INVENTION

Field of the Invention

The present invention relates to an installation and a method for rolling a metal strip. The installation includes a rolling mill in which the strip is rolled in continuous movement, rolling agents brought into contact with rolls of the rolling mill and with the strip, a strip traction unit positioned at the output of the rolling mill, and a decontamination module with at least one degreasing means positioned between the output of the rolling mill and the traction unit so as to remove residual agents from the strip at the output of the rolling mill.

Installations for rolling metal strip, in particular cold rolling, that are able to roll strips made primarily of stainless steel, require the use of a high-capacity rolling mill (>400,000 tons per year) such as a tandem mill. Rolling is carried out continuously (i.e. the strip is in continuous movement) to limit the costly loss of time and material caused by inserting and releasing the strip, as required in a non-continuous rolling mill. Upstream of the rolling mill, the use of a welder makes it possible to join successive strip tails and heads together in an uncoiling section provided by at least one uncoiler. Downstream of the rolling mill or at least at the end of a complete rolling line, it is ultimately necessary to separate these strips to wind them onto different coils using at least one coiler.

The surface condition of the strip is a critical element in strip quality throughout the rolling line, on account of which frequent visual inspections are often required.

Rolling installations such as tandem rolling installations (designed for carbon- and stainless-steel strips) are preferably fitted with dual coilers, positioned at the downstream outlet of the rolling mill and downstream of shears used to cut the strip, preferably on the fly, and separate same to form separate strips which are then coiled alternately onto two mandrels, exerting a suitable degree of traction on the strip upstream of the coiling in consideration of the conditions required for good coiling, good coil performance once off the coiler mandrel and subsequent uncoiling stresses on the multi-operation lines downstream of the rolling operation. The strip traction required for coiling is usually different from that required for rolling. The strip traction related to rolling is usually greater or much greater than the strip traction required for coiling. During cutting and transfer of the head of a strip to the related coiler, traction is usually only provided or permitted using a traction unit such as a pinch roll able to establish less traction than the strip traction required at the rolling-mill output for good rolling conditions, which may result in a disturbance in the strip thickness and generation of a final product that is out of tolerance and therefore downgraded and often unusable, which is very costly in particular in the case of stainless steel production. Equally, the strip rolling speed at the output of the rolling mill has to be reduced during operations downstream of the output of the rolling mill, in particular when cutting the strip (shearing, start of coiling on a mandrel, insertion of paper strip between coil windings when producing stainless steel, inspection, etc.), which results in a significant loss of productivity and impacts quality factors relating to the rolling method, which leads to faults in the thickness and flatness of the strip after rolling and in general all well-known quality issues caused by transient states relating to speed variations and/or low speeds. In the field of stainless steel strips, inserting a paper sheet or film between the windings of the resulting coils requires a very low transfer/insertion speed, for example around 30 to 60 m/min and/or the use of complex and costly machinery to insert this sheet on the fly at a speed of for example 60 to 100 m/min.

This speed reduction results in a loss of rolling productivity and an increase in rolling stress, which may negatively impact the parameters of the rolled product outputted.

A rolling installation belonging to Nisshin Steel Company Limited (publication GB1313577) has been described, disclosing a tandem rolling mill for continuous production of stainless steel strip. The tandem rolling mill is provided with successive rolling stands (20 high) that require longer, non-automated roll change times, as well as "double pinch" bridle rolls upstream and downstream of the rolling mill which may cause surface, thickness or flatness defects on the strip. This installation is however a good starting example for the present invention, inasmuch as it describes a rolling installation for a metal strip comprising at least:

- a rolling mill in which the strip is rolled in continuous movement,
- a strip traction unit positioned at the output of the rolling mill.

It should be noted that the present invention also takes into account lubrication and cooling means inside the rolling mill (on the rolling mill rolls and therefore on the strip) in order to guarantee a predetermined coiling, compression and sliding ratio of the strip between the rolls beneath the strip contact arc on the rolling rolls. This makes it possible to obtain a lubrication/cooling rate that is usable for rolling in the rolling mill, firstly to cool the rolled strip and secondly to achieve, under good conditions and under rolling stresses, a desirable ratio between the coiling, compression and sliding of the strip moving through the rolling mill.

At the output of the rolling mill, the surface of the strip retains residual rolling agents such as traces of oil and other strip and roll liquid spray elements used in the rolling process, as well as grease from miscellaneous possible sources. The presence of oil or other greasy substances on the strip makes it difficult to exert significant traction stresses on the strip coming out of the rolling mill for good rolling conditions. Since traction is generated by a traction unit at the output of the rolling mill, such as bridle rolls and/or pinch rolls, these traction elements are necessarily coated with oil, other greasy substances or other residues, which definitively reduces the friction ratio and adherence required to exert traction on the strip. Furthermore, slipping causes and facilitates lateral deviations of the strip along the route of same up to the coiler (for example in an accumulator at the output of the rolling mill and/or on the coiler), which reduces productivity. In this case, means are required to prevent and correct these strip position deviations which result in a real loss of control of the strip movement characteristics, such as loss of traction, accumulation and/or coiling precision, in particular on the fields of the coils. Oil, other greasy substances and other residues remaining on the surface of the strip coming out of the rolling mill are also contaminants, affecting the final cleanliness of the strip, adversely affecting the end quality of same and adversely affecting the mechanical and clean conservation properties of the paper strip required for strip coiling in the specific case of stainless strips to be coiled.

BRIEF SUMMARY OF THE INVENTION

One purpose of the present invention is to propose a high-productivity installation and a method for rolling a metal strip, guaranteeing increased control of strip movement characteristics regardless of any operations undertaken at the output of the rolling mill, and in particular between at least one traction unit downstream of a rolling mill and a final coil downstream of the traction unit.

Accordingly, the installation according to the invention must in particular be able to enhance productivity for a primarily stainless strip. As such, given that strip coiling including insertion of a paper film is usually carried out at the end of a rolling line to protect the strip surface between the coiled windings, the installation according to the invention must enable simpler, more robust and more reliable insertion of the paper film.

Such an installation is proposed by the features as claimed, as well as a method as claimed.

A set of sub-claims also sets out the advantages of the invention.

BRIEF DESCRIPTION OF THE SEVERAL VIEWS OF THE DRAWING

An exemplary embodiment of the installation and of the application of the method according to the invention is provided using FIG. 1 and the related description below. A variant of the output of said installation in the same exemplary embodiment is also provided in FIG. 2.

DESCRIPTION OF INVENTION

Figure 1:
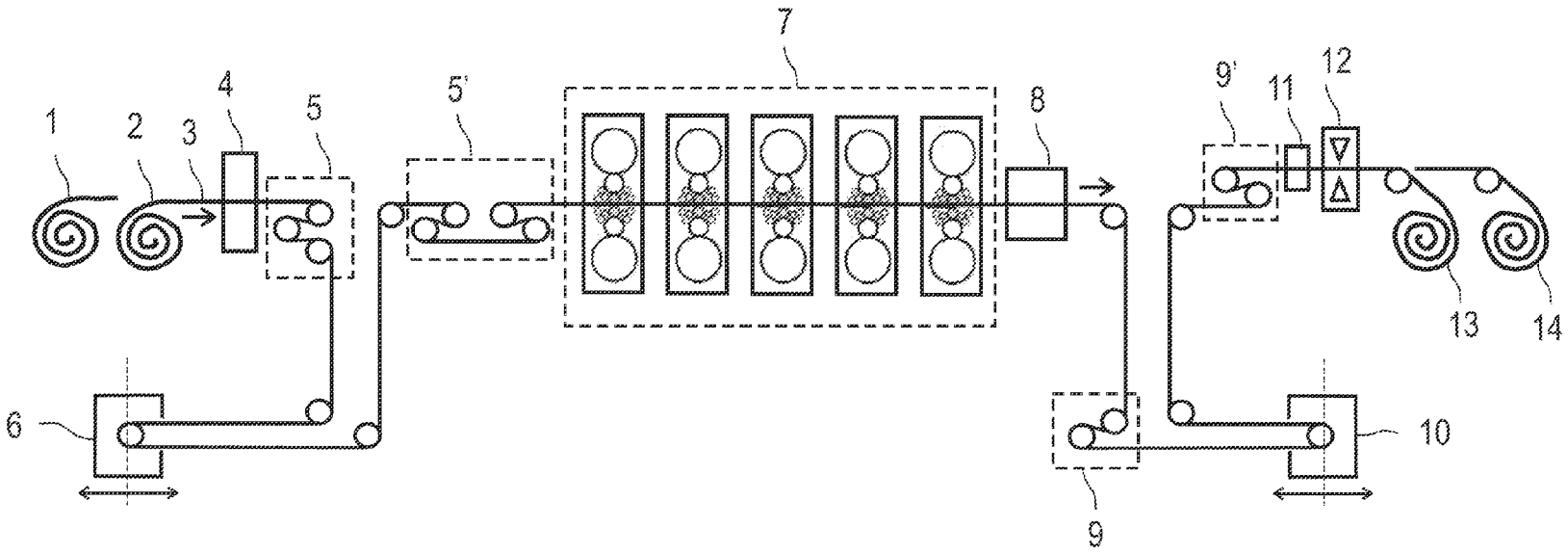

On the basis of a rolling installation for a metal strip (3) shown in FIG. 1 including at least:

- a rolling mill (7) in which the strip (3) is rolled in continuous movement (in the direction of the arrow with reference sign 3),
- rolling agents brought into contact with the rolls of the rolling mill and with the strip, said agents including at least lubrication and cooling means inside the rolls of the rolling mill (commonly arranged in at least one stand of the rolling mill (7), five stands being shown in this case) in order to guarantee an optimum predefined ratio between the coiling, compression and sliding properties of the strip between the rolling rolls,
- a strip traction unit (9) arranged at the output of the rolling mill, said traction unit being part of an assembly of a plurality of traction units (for the sake of clarity, FIG. 1 shows only two traction units 9, 9') distributed between the output of the rolling mill and an output of the installation, such as a coiler (13, 14) or a coupled metal treatment line (not shown), the installation according to the invention is characterized in that a decontamination module (8) comprising at least degreasing means, followed preferably by brushing, rinsing and drying means, is positioned between the output of the rolling mill and the traction unit so as to remove said residual agents from the strip at the output of the rolling mill.

Advantageously, at the output of the decontamination module (8), the strip has greater adherence and therefore is better controlled as it moves over the deflector rolls and at the input of each of the traction units (9, 9'), of an accumulator (10) downstream of at least one part (9) of the traction units (9, 9') and the other installations downstream of the rolling mill. Strip path deviations, in particular lateral deviations, are therefore avoided since greater control of the strip movement characteristics is achieved regardless of the operations undertaken at the output of the rolling mill, in particular between at least the first traction unit (9) downstream of the rolling mill and a final coiling (13, 14) downstream of the traction unit. The increased adherence also means that strip pinch means (complementing or worse replacing bridle rolls) such as those of the traction unit (9) are hardly necessary or even unnecessary. Thus, the traction unit (9, 9') may comprise only bridle rolls for the moving strip to exert greater traction by tension, said unit in particular potentially optionally only comprising pinch means to exert little or no additional traction. This results in fewer strip defects caused by pinch means, and therefore higher productivity and quality. Better controlling the characteristics of the path of the moving strip, and limiting or eliminating the number of pinch rolls also makes it possible to increase the movement speed of the strip, which is "better guided using no active guide means such as pinch rolls" up to the accumulator (10) downstream of the rolling mill. This also considerably increases productivity in strip rolling.

Figure 2:
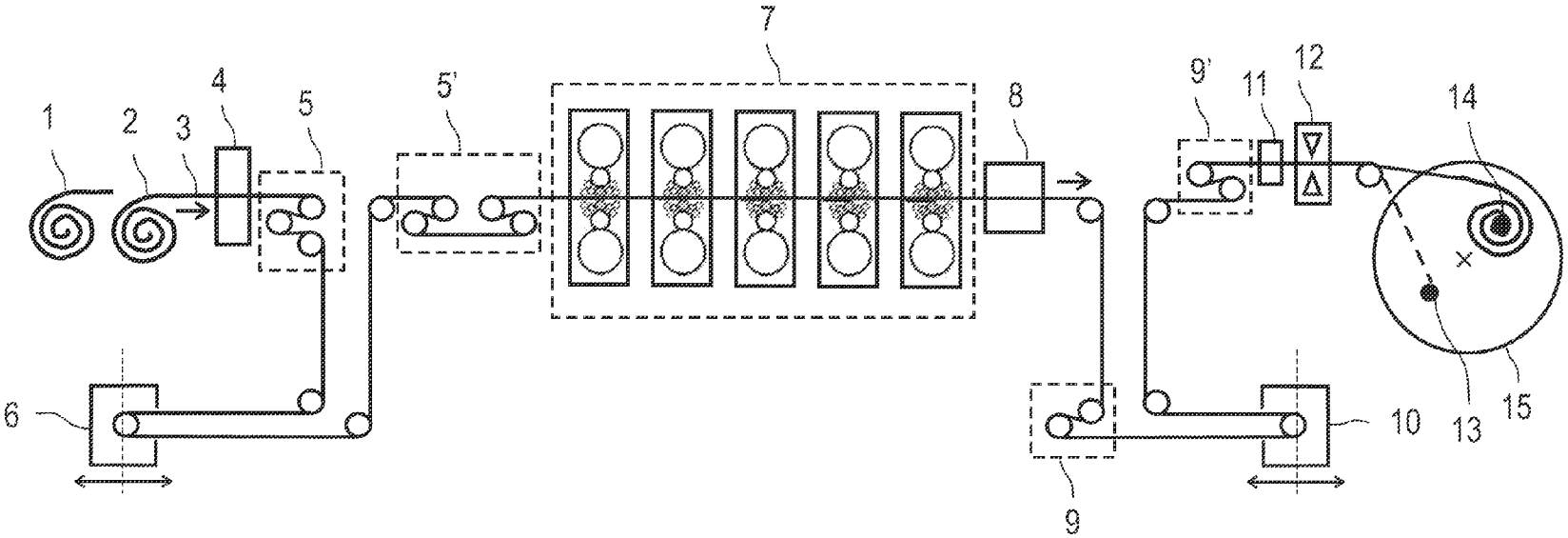

The installation according to the invention is particularly suited to high productivity in terms of the end product for a continuously moving strip comprising primarily a stainless metal. Indeed, two advantageous aspects can be seen:

- it has been shown that an increased movement speed in the rolling mill (7) is possible up to the accumulator (10) according to the invention on account of the greater control of the path of the strip coming out of the rolling mill. The strip accumulator (10) is arranged at the output of at least one "first" part (9) of the traction units (9, 9'), thereby enabling a strip movement speed at the output of the rolling mill and of said accumulator to be kept beneath a maximum threshold, or to reach a low speed or to stop briefly at the output of said accumulator. In short, this speed reduction downstream of the accumulator advantageously makes it possible, at the output of the installation according to the invention, to carry out an inspection (see visual/optical/acoustic/mechanical/etc. strip inspection module (11) arranged downstream of the output of the strip accumulator (10)), shearing (12), transfer of the strip from a coiler (13) to another coiler (14), etc. on a strip portion that is almost or completely stationary. The means used to carry out these inspection operations, shearing, insertion of the paper strip in the coil, etc. are made more simple than the same operations carried out if the strip is moving faster. For example, the output of the accumulator (10) can be simply coupled to an inlet of a coiler (13), for which shears (12) are positioned upstream of same to cut said stationary strip. In the example in FIGS. 1 and 2 with an output from the installation that is more dynamic on account of the increased productivity of the rolling operation, the output of the accumulator (10) can be coupled to an input of two coilers (13, 14) or (13, 14, 15 in FIG. 2) for which shears (10) are arranged upstream of same that can cut a (moving) strip on the fly, the two coilers being arranged either separately (FIG. 1) or in a pair on a carousel drum (15) (see FIG. 2). As such, FIGS. 1 and 2 show continuous coiling means designed to enable the high productivity of the invention.
- a paper-strip insertion module (not shown, for the sake of clarity) is positioned downstream of the output of the strip accumulator (10). Given that the accumulator enables the strip speed to be significantly reduced at the output of same (in contrast to the very high speed at which the strip enters the accumulator), said insertion module need not be complex, unlike a more sophisticated and costly module required for higher strip speeds. This also makes the strip coiling procedure more simple, robust and reliable. This represents an undeniable advantage in relation to stainless steel strips.

The installation according to the invention discloses a control module for the degreasing unit that can be controlled using the parameters of the installation and the physical properties of the moving strip, such as at least a lubrication rate applied to the rolling mill (7) and a maximum strip coiling factor ensured by the traction unit (9, 9'). This control system enables greater optimization of the settings of the decontamination module in order to make decontamination cheaper in terms of the use of degreasing products or other decontaminants while guaranteeing optimum decontamination (which is therefore environmentally friendly) in order to better control traction and the path of the strip and to improve productivity.

The installation according to the invention comprises, successively from the main input of same upstream of the rolling mill, at least one uncoiler (1, 2), one welder (4), one accumulator (6) and at least one traction unit (5, 5'). Again in this case, these coupled elements enable high movement speeds upstream of the rolling mill, given that the invention enables the movement speed of the rolling to be increased with increased productivity on account of better control of the strip path downstream of the rolling mill.

Finally, the installation according to the invention may include, downstream of the traction unit (9, 9'), at least one annealing pickling line (APL) and other underlying cold annealing pickling lines (CAPL) that are either coupled directly with the strip moving continuously or coupled via at least one coiler downstream of the traction unit up to an uncoiler at the input of the CAPL. Direct coupling has a drawback in terms of movement speed, since the CAPL requires strip movement speeds much lower than those achieved by the installation according to the invention. As a result of this, to achieve high levels of productivity when coupling the installation according to the invention to a CAPL, it is nowadays more attractive to use separate coiler/uncoiler couplers, then to transfer the coils at the output of the installation according to the invention to ideally several different CAPLs.

A method for implementing the installation according to the invention is also proposed, in which:

- in a first step, the movement speed of a strip in a rolling mill (7) until the strip enters an accumulator (10) downstream of the rolling mill reaches a maximum speed, such as 400 to 600 m/min,
- in a second brief step, the accumulator (10) starts releasing strip to at least one coiler (13, 14) at a speed lower than the speed in the first step, such as 30 to 60 or 100 m/min,
- in a third step, after said brief step, the coiler reaches a maximum strip coiling speed, for example greater than 550 m/min or 750 m/min.

The three steps mentioned above mean that the flexibility to adapt the speeds at the output of the rolling mill (high speed), at the output of the accumulator (low speed) and during coiling (high speed) tends to significantly increase the overall productivity of the installation. The speed differences given are examples provided using current technology, and they may naturally be changed, the application and protection of the invention not being limited to these differences.

Advantageously, this method enables inspection (11) and shearing (12) to be performed during the second step when the strip movement speed is reduced.

Equally, the method according to the invention enables insertion of a paper sheet on the strip, also during the second step when the strip movement speed is reduced.

The invention claimed is:

1. An installation for rolling a metal strip, the installation comprising:

- a rolling mill for rolling the strip in continuous movement, said rolling mill having rolls and an output;
- rolling agents brought into contact with said rolls of said rolling mill and with the strip;
- a strip traction unit positioned downstream of said rolling mill in a strip movement direction, said strip traction unit having a traction unit output;
- a decontamination module with at least one degreaser positioned between said output of said rolling mill and said traction unit for removing residual said agents from said strip at said output of said rolling mill;
- a strip accumulator positioned at said traction unit at an output of at least one part of said traction unit; and
- a paper-strip insertion module positioned downstream of an output of said strip accumulator in the strip movement direction.

2. The installation according to claim 1, wherein said strip accumulator is configured to keep a speed of movement of the strip at the output of said accumulator below a maximum threshold.

3. The installation according to claim 1, wherein the strip is a strip primarily of stainless metal.

4. The installation according to claim 3, which further comprises a coiler having an input coupled to the output of said accumulator, and shears positioned upstream of said coiler for cutting an intermediately stationary strip.

5. The installation according to claim 3, which further comprises two coilers each having an input, and shears positioned upstream of said two coilers for cutting the strip on the fly.

6. The installation according to claim 5, wherein said two coilers are separately positioned coilers or a pair of coilers disposed on a carousel drum.

7. The installation according to claim 3, further comprising a strip inspection module positioned downstream of the output of said strip accumulator.

8. The installation according to claim 1, wherein said strip accumulator is positioned at the output of at least one part of said traction unit to ensure an intermediate stoppage time at the output of said accumulator.

9. The installation according to claim 1, further comprising a control module for said decontamination module, said control module being configured for control with parameters of the installation and physical properties of the moving strip.

10. The installation according to claim 9, wherein said control module is controlled, inter alia, by parameters including a lubrication rate applied to the rolling mill and a maximum strip coiling factor ensured by said traction unit.

11. The installation according to claim 1, wherein said traction unit comprises bridle rolls for the moving strip to exert increased traction by tension.

12. The installation according to claim 11, wherein said traction unit includes pinch means to exert little or no additional traction.

13. The installation according to claim 1, further comprises at least one uncoiler, one welder, one accumulator, and at least one traction unit disposed upstream of said rolling mill.

14. The installation according to claim 1, further comprising at least one cold annealing pickling line downstream of said traction unit and coupled either directly with the strip in continuous movement or coupled via at least one coiler downstream of said traction unit up to an uncoiler at an input of said at least one cold annealing pickling line.

15. A method of rolling a metal strip, the method comprising:

providing the installation according to claim 1;

in a first step, setting a strip movement speed in the rolling mill until the strip enters the accumulator downstream of the rolling mill to reach a maximum strip movement speed;

in a brief, second step, starting to release strip from the accumulator to at least one coiler at a speed lower than the strip movement speed in the first step; and in a third step following the second step, coiling the strip with the coiler at a maximum strip coiling speed that is greater than the strip movement speed in the first step.

16. The method according to claim 15, wherein the maximum strip movement speed lies in a range from 400 to 600 m/min, a strip release speed in the second step lies in a range from 30 to 60 or 100 m/min, and the strip coiling speed is greater than 550 m/min or 750 m/min.

17. The method according to claim 15, which comprises inspecting and shearing the strip during the second step.

18. The method according to claim 15, which comprises starting an insertion of a paper sheet on the strip during the second step.

* * * * *